US010531726B2

(12) United States Patent
Redford et al.

(10) Patent No.: US 10,531,726 B2
(45) Date of Patent: Jan. 14, 2020

(54) BRUSH ASSEMBLY

(71) Applicant: Walmart Apollo, LLC, Bentonville, AR (US)

(72) Inventors: Sarah A. Redford, Bella Vista, AR (US); Bennjamin Scott Manning, Bentonville, AR (US)

(73) Assignee: Walmart Apollo, LLC, Bentonville, AR (US)

( * ) Notice: Subject to any disclaimer, the term of this patent is extended or adjusted under 35 U.S.C. 154(b) by 209 days.

(21) Appl. No.: 15/718,086

(22) Filed: Sep. 28, 2017

(65) Prior Publication Data

US 2018/0084896 A1 Mar. 29, 2018

Related U.S. Application Data

(60) Provisional application No. 62/401,400, filed on Sep. 29, 2016.

(51) Int. Cl.
*A46B 5/00* (2006.01)
*A46B 15/00* (2006.01)

(52) U.S. Cl.
CPC ..... *A46B 5/0095* (2013.01); *A46B 15/0061* (2013.01); *A46B 2200/3006* (2013.01)

(58) Field of Classification Search
CPC . A46B 5/0095; A46B 5/0016; A46B 15/0061; A46B 2200/3006
See application file for complete search history.

(56) References Cited

U.S. PATENT DOCUMENTS

| | | | | |
|---|---|---|---|---|
| 5,491,863 | A | 2/1996 | Dunn | |
| 5,709,003 | A * | 1/1998 | Batch | A46B 13/001 15/106 |
| 7,017,222 | B2 | 3/2006 | Dunn | |
| D683,544 | S * | 6/2013 | Duwa | D4/121 |
| D694,018 | S | 11/2013 | Williams et al. | |
| 2001/0054211 | A1* | 12/2001 | Cabedo-Deslierres | A46B 5/0016 15/106 |
| 2007/0274762 | A1 | 11/2007 | Edwards et al. | |
| 2016/0354187 | A1* | 12/2016 | Zmiyiwsky | A61C 15/02 |

OTHER PUBLICATIONS

Bottle Brush, Small pet bottle brush cleans any size water bottle with ease, http://www.drsfostersmith.com/product/prod_display.cfm?pcatid=11184, last viewed Jul. 20, 2016.
NaturlaFit Bottle Brush Set, Chicco, http://www.chiccoshop.com/feeding/accessories/naturalfitbottlebrushset/00069189400070.html, last viewed Jul. 20, 2016.
LATCH Pump Brushes, munchkin, http://www.munchkin.com/latchtradepumpbrushes.html, last viewed Jul. 20, 2016.
30133 No-Scratch Bottle Brush, http://www.sassybaby.com/30133noscratchbottlebrush, last viewed Jul. 20, 2016.

* cited by examiner

*Primary Examiner* — Shay Karls
(74) *Attorney, Agent, or Firm* — McCarter & English, LLP; David R. Burns

(57) ABSTRACT

A brush assembly including a handle with a main brush, a first auxiliary brush detachably engaged with a cap, and a second auxiliary brush extending from the cap is described. The cap, when removed from the handle, exposes the first auxiliary brush. Disengagement of the cap from the first auxiliary brush exposes the second auxiliary brush.

20 Claims, 10 Drawing Sheets

BRUSH ASSEMBLY

CROSS-REFERENCE TO RELATED APPLICATIONS

This application claims the benefit of commonly assigned U.S. Provisional Patent Application No. 62/401,400, which was filed on Sep. 29, 2016. The entire content of the foregoing provisional patent application is incorporated herein by reference.

BACKGROUND

Different types of products are used to clean containers such as bottles. For example, sponges may be used to clean different types of surfaces including containers. Similarly, specially designed brush systems may be used to clean particular types of bottles such as baby bottles and "sippy" cups.

SUMMARY

Exemplary embodiments of the present invention provide a brush assembly that includes brushes of different sizes that are secured to a handle to prevent misplacement of the brushes. More particularly, the exemplary brush assembly includes an exterior brush and two brushes that are housed within the handle body. Removal of a cap from the handle body exposes the inner brushes for use. Attachment of each brush to a component of the handle ensures that the brushes will not be misplaced.

In one embodiment, an exemplary brush assembly is provided that includes a handle. The handle includes a body with a brush end and a cap end. The body is at least partially hollow to define an inner chamber. The handle includes a cap removable from the cap end of the body. The cap is configured to be positioned in an attached position when attached to the cap end of the body and a removed position when removed from the cap end of the body. The brush assembly includes a main brush attached to and extending from the brush end of the body. The brush assembly includes a first auxiliary brush detachably engaged with the cap and including a body with an inner chamber. The first auxiliary brush is enclosed within the inner chamber of the handle when the cap is in the attached position. The brush assembly includes a second auxiliary brush extending from the cap. The second auxiliary brush is enclosed within the inner chamber of the first auxiliary brush when the cap is in the attached position.

The handle includes a central longitudinal axis. The first and second auxiliary brushes extend in the same direction when the cap is in the attached position. The main brush, the first auxiliary brush, and the second auxiliary brush are aligned along the central longitudinal axis when the cap is in the attached position. In a nested or assembled configuration, the second auxiliary brush is nested within the first auxiliary brush, and the first auxiliary brush is nested within the handle, with both auxiliary brushes being nested within the handle of the main brush.

In an embodiment, the handle includes a first diameter at or near the cap end and a second diameter at or near the brush end. The first diameter is dimensioned greater than the second diameter to define a tapered body. The cap includes an upper half with an inner chamber. A cap end of the first auxiliary brush detachably engages an inner surface of the inner chamber of the cap. The cap end of the first auxiliary brush includes a radial protrusion and the upper half of the cap includes an aperture. The radial protrusion detachably engages with the aperture of the cap to interlock the first auxiliary brush with the cap. The upper half of the cap is configured to be nested within the cap end of the handle. The cap includes a lower half with an opening passing therethrough.

In another embodiment, an exemplary brush assembly is provided that includes a handle. The handle includes a body with a brush end and a cap end. The body is at least partially hollow to define an inner chamber. The handle includes a cap removable from the cap end of the body. The cap is configured to be positioned in an attached position when attached to the cap end of the body and a removed position when removed from the cap end of the body. The brush assembly includes a first brush detachably engaged with the cap and including a body with an inner chamber. The first brush is enclosed within the inner chamber of the handle when the cap is in the attached position. The brush assembly includes a second brush extending from the cap. The second brush is enclosed within the inner chamber of the first brush when the cap is in the attached position.

In another embodiment, an exemplary brush assembly is provided that includes a handle. The handle includes a body with a brush end and a cap end. The body is at least partially hollow to define an inner chamber. The handle includes a cap removable from the cap end of the body. The cap is configured to be positioned in an attached position when attached to the cap end of the body and a removed position when removed from the cap end of the body. The brush assembly includes a main brush attached to and extending from the brush end of the body. The brush assembly also includes a first auxiliary brush extending from the cap. The first auxiliary brush is enclosed within the cap and the inner chamber of the handle when the cap is in the attached position. The brush assembly further includes a second auxiliary brush extending from and beyond the cap end of the handle when the cap is in the removed position. The second auxiliary brush is enclosed within the cap and inner chamber of the handle when the cap is in the attached position.

In another embodiment, an exemplary brush assembly is provided that includes a handle. The handle includes a body with a brush end and a cap end. The body is at least partially hollow to define an inner chamber. The handle includes a cap removable from the cap end of the body. The cap is configured to be positioned in an attached position when attached to the cap end of the body and a removed position when removed from the cap end of the body. The brush assembly also includes a first brush extending from the cap. The first brush is enclosed within the cap and the inner chamber of the handle when the cap is in the attached position. The brush assembly further includes a second brush extending from and beyond the cap end of the handle when the cap is in the removed position. The second brush is enclosed within the cap and inner chamber of the handle when the cap is in the attached position.

It should be appreciated that other combinations and/or permutations of embodiments are envisioned as also being within the scope of the present invention. Other objects and features will become apparent from the following detailed description considered in conjunction with the accompanying drawings. It is to be understood, however, that the drawings are designed as an illustration only and not as a definition of the limits of the present disclosure.

BRIEF DESCRIPTION OF THE DRAWINGS

To assist those of skill in the art in making and using the disclosed brush assemblies, reference is made to the accompanying figures. The accompanying figures, which are incorporated in and constitute a part of this specification, illustrate one or more embodiments of the invention and, together with the description, help to explain the invention. In the figures.

DETAILED DESCRIPTION

It should be understood that the relative terminology used herein, such as "front", "rear", "left", "top", "bottom", "vertical", "horizontal", "up" and "down" is solely for the purposes of clarity and designation and is not intended to limit embodiments to a particular position and/or orientation. Accordingly, such relative terminology should not be construed to limit the scope of the present disclosure. In addition, it should be understood that the scope of the present disclosure is not limited to embodiments having specific dimensions. Thus, any dimensions provided herein are merely for an exemplary purpose and are not intended to limit the invention to embodiments having particular dimensions.

Sponges that may be used to clean containers generally contribute to microbial growth if not stored under proper conditions. Traditional brush systems which can be used to clean containers can include brushes of different sizes, some of which are small and easily misplaced. Exemplary embodiments of the present invention address these concerns and provide a brush assembly that includes brushes of different sizes that are secured to a handle to prevent misplacement of the brushes. More particularly, the exemplary brush assembly includes an exterior brush and two brushes that are housed within the handle body. Removal of a cap from the handle body exposes the inner brushes for use. Attachment of each brush to a component of the handle ensures that the brushes will not be misplaced.

Figure 1:
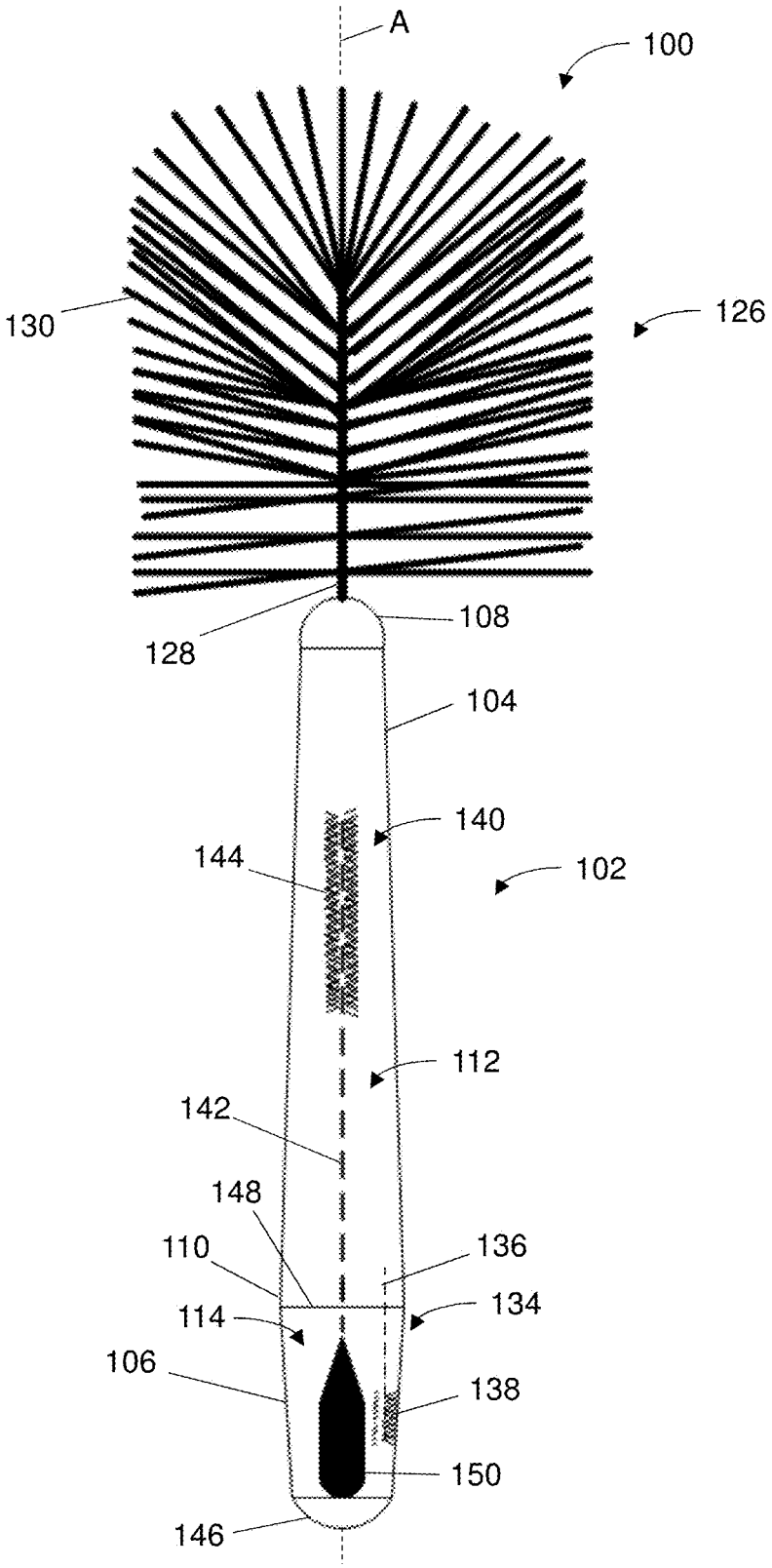
FIG. 1 is a diagrammatic front view of an exemplary brush assembly in an embodiment.
Figure 2:
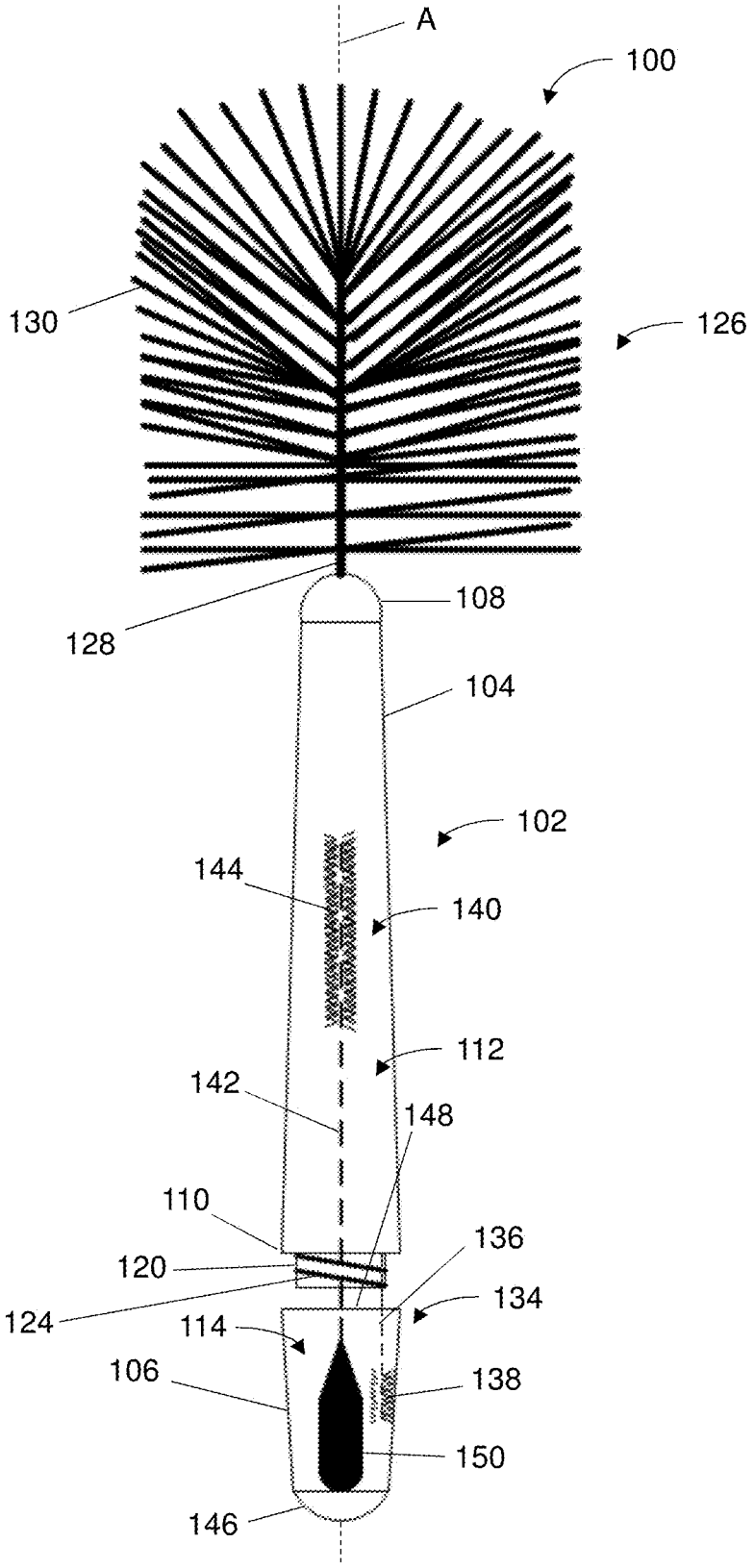
FIG. 2 is a diagrammatic front view of an exemplary brush assembly in an embodiment including a cap disengaged from a handle body.
Figure 3:
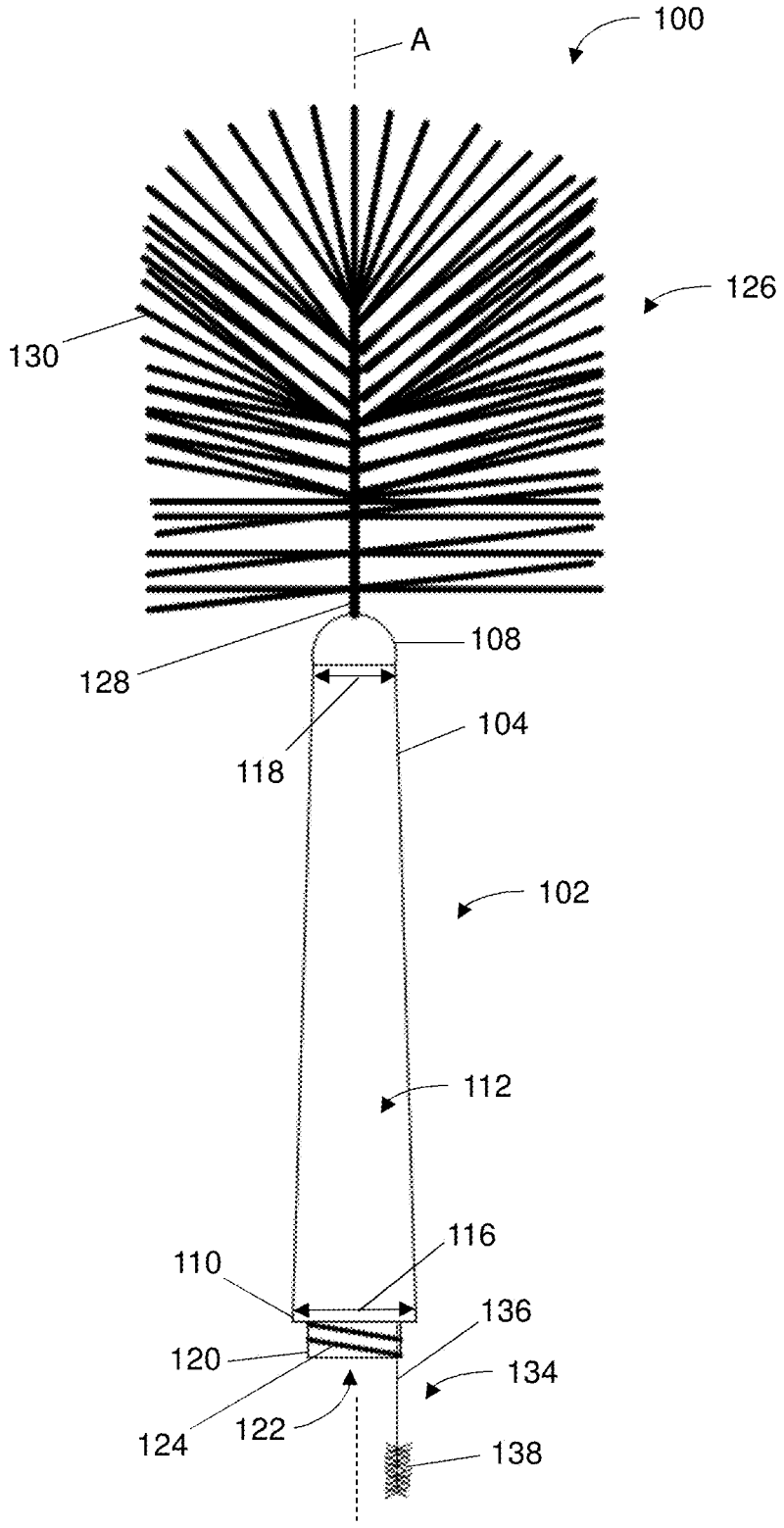
FIG. 3 is a diagrammatic front view of an exemplary brush assembly in an embodiment including a main brush and a second brush.
Figure 4:
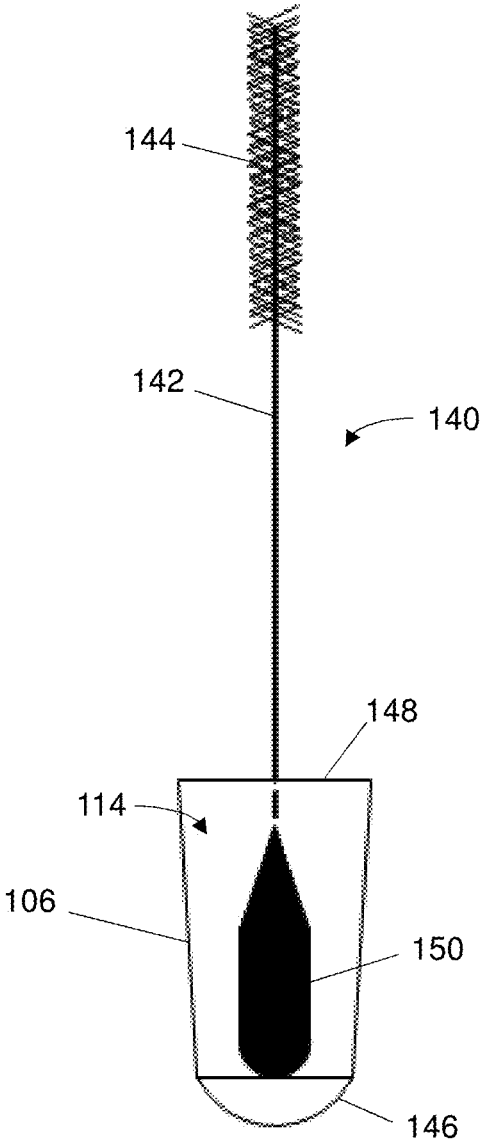
FIG. 4 is a diagrammatic front view of an exemplary cap of a brush assembly in an embodiment including a first brush.

FIGS. 1-4 are diagrammatic front views of an exemplary brush assembly 100 in accordance with exemplary embodiments. More particularly, FIG. 1 is a diagrammatic front view of an exemplary brush assembly in an embodiment. FIG. 2 is a diagrammatic front view of an exemplary brush assembly depicting a cap disengaged from a handle body. FIG. 3 is a diagrammatic front view of an exemplary brush assembly in an embodiment including a main brush and a second brush. FIG. 4 is a diagrammatic front view of an exemplary cap of a brush assembly in an embodiment including a first brush.

As depicted in FIGS. 1-4, the brush assembly 100 generally includes a handle 102 including a body 104 and a cap 106. In an embodiment, the handle 102 can be fabricated from, e.g., stainless steel, copper, thermoplastic elastomer (TPE), polypropylene, polyethylene, polystyrene, polyvinyl chloride, polycarbonate, acrylonitrile butadiene styrene (ABS), silicone, nylon, blends of one or more materials, or the like. The cap 106 can be disengaged or removed from the body 104 into a removed position, or attached or engaged with the body 104 into the attached position. The handle 102 defines an elongated and substantially tubular shape. The body 104 includes a brush end 108 and a cap end 110 located on opposing sides of the body 104. The handle 102 is at least partially hollow (e.g., substantially hollow) to define an inner chamber 112 in the body 104 and an inner chamber 114 in the cap 106.

In an embodiment, the body 104 can taper from a first diameter 116 at or near the cap end 110 to a second diameter 118 at or near the brush end 108. In particular, the first diameter 116 is dimensioned greater than the second diameter 118, and the diameter of the handle 102 gradually tapers from the cap end 110 to the brush end 108. In an embodiment, the outer diameter of the body 104 can be substantially uniform. In an embodiment, the outer surface of the body 104 can be ergonomically shaped to improve the grip of the user on the handle 102.

The body 104 may include a cylindrical extension 120 at the cap end 110. One end of the extension 120 includes an opening 122 into the inner chamber 112. The outer surface of the extension 120 may include threads 124 for engagement with complementary threads on an inner surface of the cap 106. A brush 126 (e.g., a main brush) is attached to and extends from the brush end 108 of the body 104. The main brush 126 can be in the form of a bristle top brush including an elongated support 128 and bristles 130 extending from the elongated support 128. In an embodiment, the elongated support 128 can be formed from, e.g., braided metal, plastic, solid metal, hollow metal, or the like. In an embodiment, the bristles 130 can be fabricated from, e.g., stainless steel, copper, thermoplastic elastomer (TPE), polypropylene, polyethylene, polystyrene, polyvinyl chloride, polycarbonate, acrylonitrile butadiene styrene (ABS), silicone, nylon, blends of one or more materials, or the like. In an embodiment, the brush assembly 100 can include a cap (not shown) configured to be positioned over the main brush 126 during storage of the brush assembly 100.

The brush assembly 100 may include a brush 140 (e.g., a first auxiliary brush). In an embodiment, the brush 140 can be in the form of a pipe cleaning brush. The brush 140 includes an elongated structure 142 and bristles 144. In an embodiment, the elongated support 142 can be formed from, e.g., braided metal, plastic, solid metal, hollow metal, or the like. In an embodiment, the bristles 144 can be fabricated from, e.g., polypropylene, stainless steel, or the like. The brush 140 can be secured or fixed to an inner surface of the cap 106 (e.g., via the elongated support 142) such that the brush 140 extends from the cap 106. The brush 140 is oriented in an opposing direction from the brush 134 along the central longitudinal axis A. In particular, the brush 140 is oriented in the same direction (e.g., upward direction) as the brush 126, while the brush 134 is oriented in an opposing direction (e.g., rotated by approximately 180 degrees). In an embodiment, the brush 140 can be secured to a central point of the cap 106 such that the brush 140 extends parallel to the central longitudinal axis A and is aligned with the central longitudinal axis A. In an embodiment, the brush 140 can instead be offset from the central longitudinal axis A instead of being aligned with the central longitudinal axis A. When the cap 106 is in the attached position, the brush 140 is enclosed within the inner chamber 112 of the body 104. When the cap 106 is in the removed position, the brush 140 is exposed for use.

The brush assembly 100 may also include a brush 134 (e.g., a second auxiliary brush). In an embodiment, the brush 134 can be in the form of a nipple brush. The brush 134 includes an elongated support 136 and bristles 138. In an embodiment, the elongated support 136 can be formed from, e.g., braided metal, plastic, solid metal, hollow metal, or the like. In an embodiment, the bristles 138 can be fabricated from, e.g., polypropylene, stainless steel, or the like. The brush 134 can be secured to the inner surface of the extension 120 (e.g., via the elongated support 136) such that the brush 134 extends from and beyond the cap end 110 of the handle 102 when the cap 106 is in the removed position. As shown in FIG. 1, when the cap 106 is in the attached position, the brush 134 fits within the inner chamber 114 and is enclosed by the cap 106. The brush 134 extends substantially parallel to a central longitudinal axis A of the handle 102, and is offset from the central longitudinal axis A. In an embodiment, the brush 134 can instead be aligned with the central longitudinal axis A instead of being offset.

The inner surface of the cap 106 may include threads complementary to the threads 124 of the body 104. Alternatively, in another embodiment, neither the cap 106 nor the body 104 may include threads and instead the cap may be sized according to the opening in the body 104 so as to provide a removable plug or cap for the opening. In an embodiment, the cap 106 includes a rounded distal end 146. In one embodiment, the outer diameter of the cap 106 can taper from a proximal end 148 towards the distal end 146. In an embodiment, the cap 106 includes an opening 150 passing through the cap 106 to allow for hanging of the brush assembly 100 on, e.g., a hook. In one embodiment, the brush 140 can be dimensioned longer than the brush 134. Alternatively, in another embodiment, the brush 140 can instead be dimensioned shorter than the brush 134.

Figure 5:
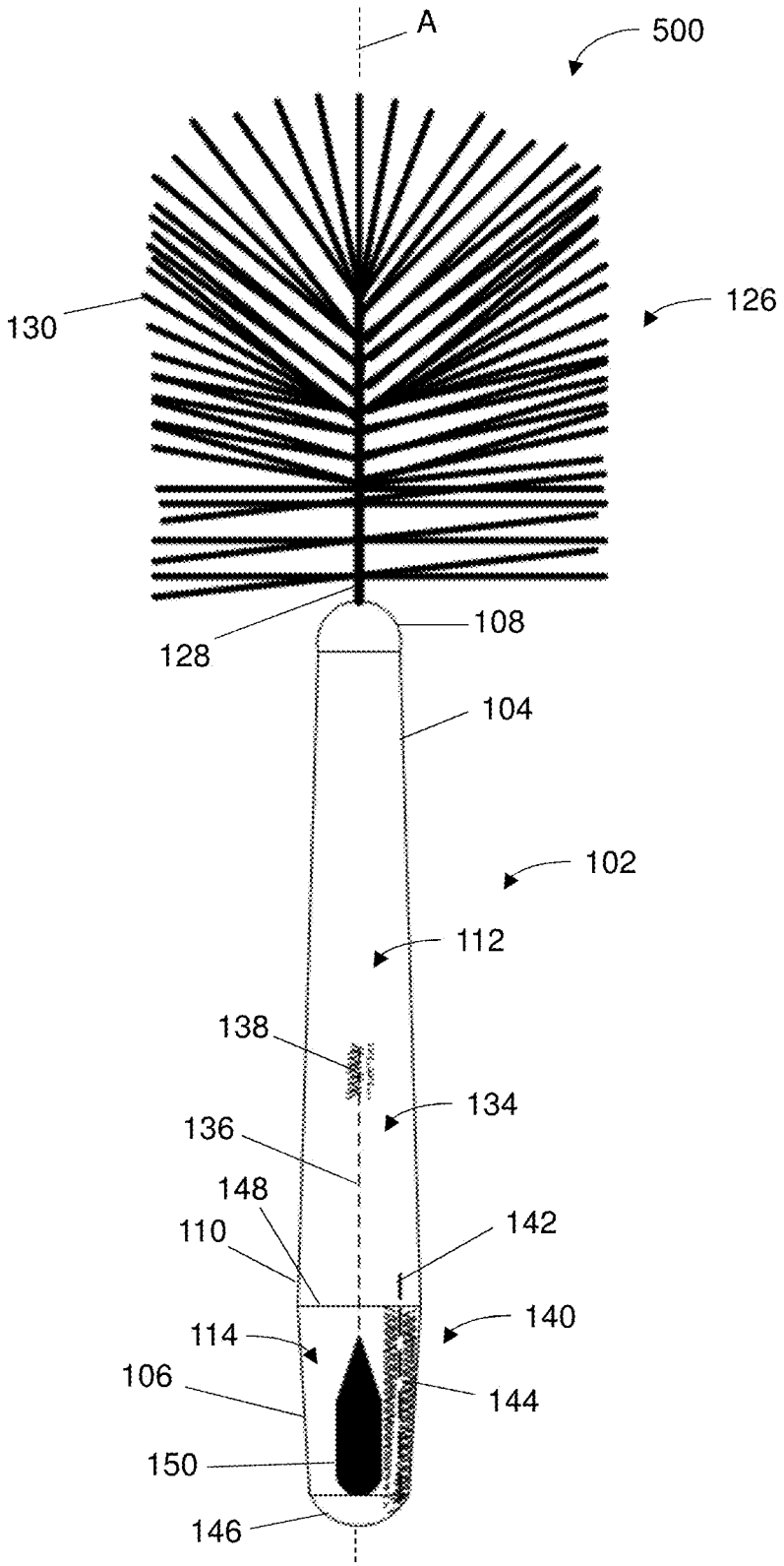
FIG. 5 is a diagrammatic front view of an exemplary brush assembly in an embodiment.
Figure 6:
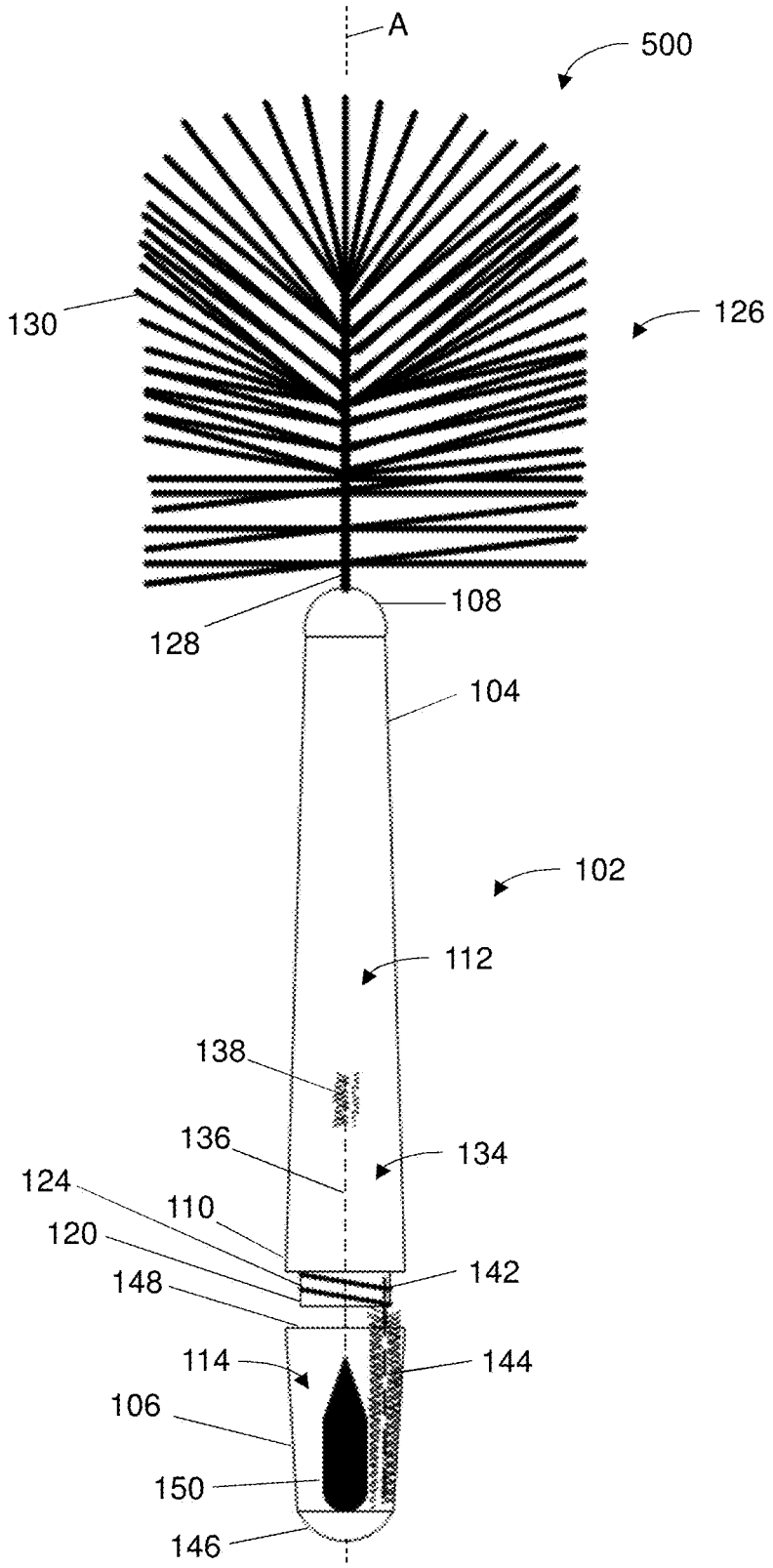
FIG. 6 is a diagrammatic front view of an exemplary brush assembly in an embodiment including a cap disengaged from a handle body.
Figure 7:
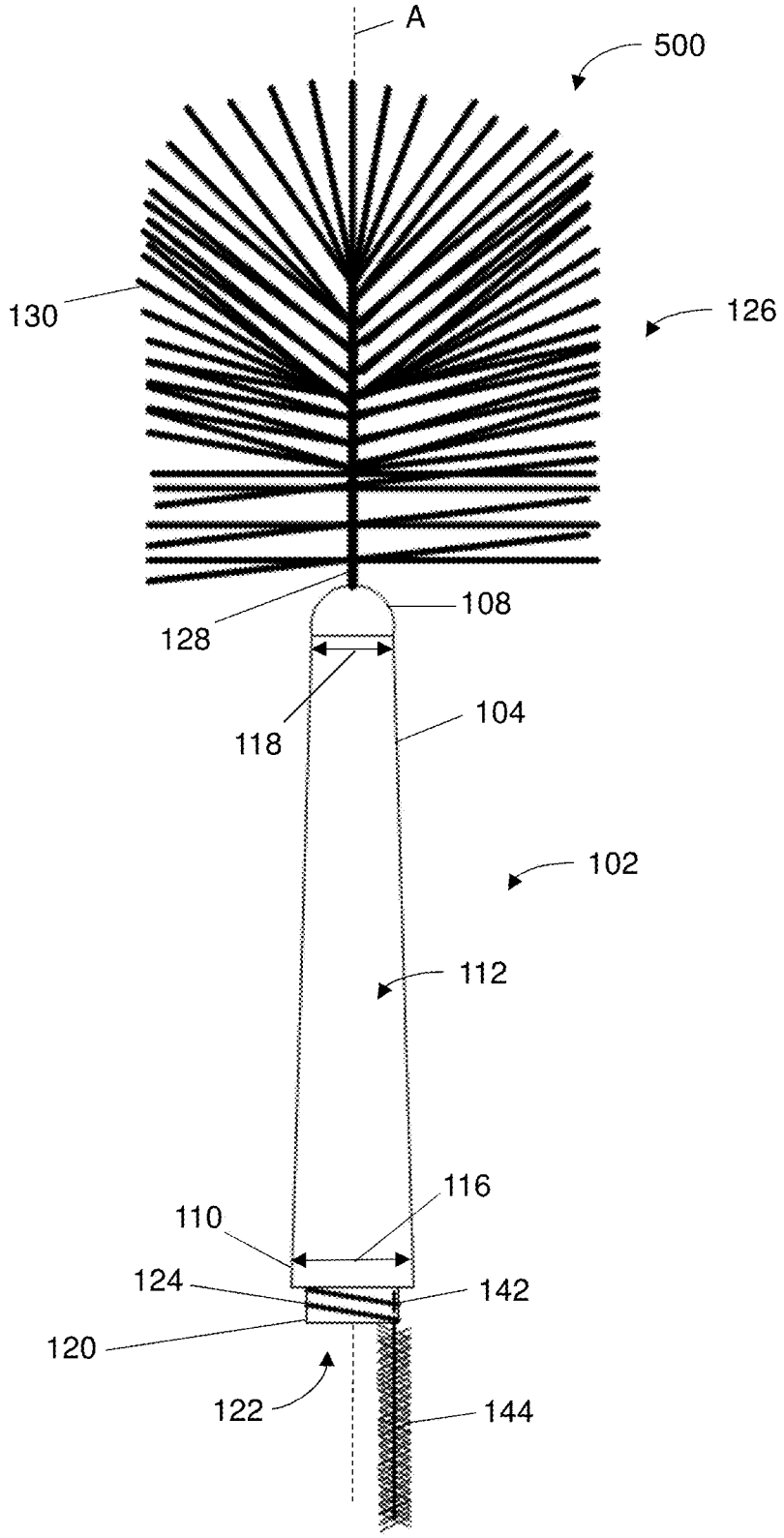
FIG. 7 is a diagrammatic front view of an exemplary brush assembly in an embodiment including a main brush and a second brush.
Figure 8:
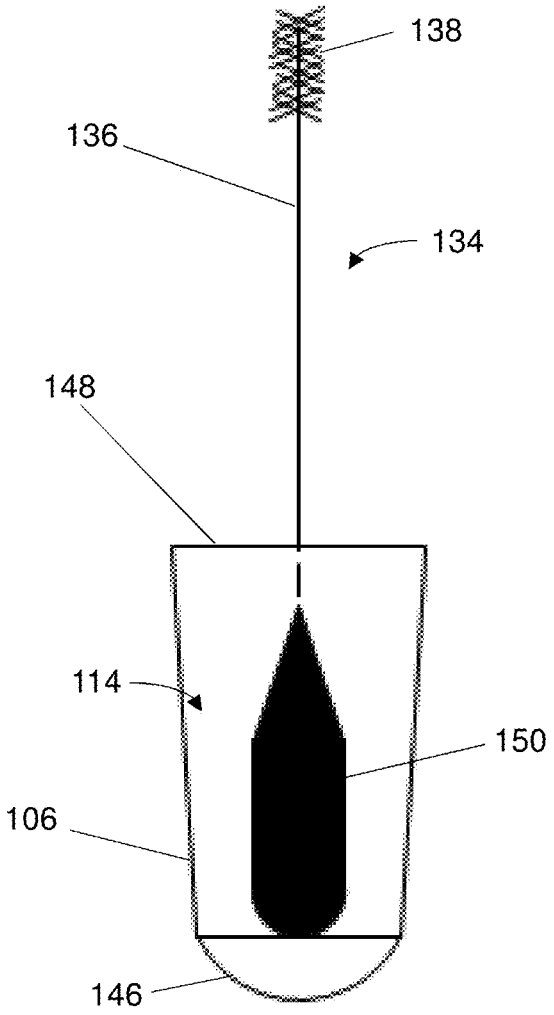
FIG. 8 is a diagrammatic front view of an exemplary cap of a brush assembly in an embodiment including a first brush.

With reference to FIGS. 5-8, diagrammatic side views of another embodiment of an exemplary brush assembly 500 are provided. More particularly, FIG. 5 is a diagrammatic front view of an exemplary brush assembly in an embodiment while FIG. 6 is a diagrammatic front view of an exemplary brush assembly in an embodiment including a cap disengaged from a handle body. FIG. 7 is a diagrammatic front view of an exemplary brush assembly in an embodiment that includes a main brush and a second brush. FIG. 8 is a diagrammatic front view of an exemplary cap of a brush assembly in an embodiment including a first brush. As depicted in FIGS. 5-8, the brush assembly 500 can be substantially similar in structure and function to the brush assembly 100, except for the distinctions noted herein. Therefore, like reference numbers are used to represent like structures.

In particular, rather than the brush 134 being fixated to the inner surface of the body 104 and the brush 140 being fixated to the inner surface of the cap 106, the brush assembly 100 includes the brush 140 fixated to the inner surface of the body 104 and the brush 134 fixated to the inner surface of the cap 106. Thus, the brush 134 extends substantially parallel to the central longitudinal axis A and is aligned with the central longitudinal axis A. The brush 140 extends substantially parallel to the central longitudinal axis A and is offset from the central longitudinal axis A. The brush 134 is oriented in an opposing direction from the brush 140 along the central longitudinal axis A. In particular, the brush 134 is oriented in the same direction (e.g., upward direction) as the brush 126, while the brush 140 is oriented in an opposing direction (e.g., rotated by approximately 180 degrees).

The exemplary brush assemblies therefore include three different types of brushes for cleaning surfaces or objects of different sizes. The largest brush can be used to clean the largest surfaces or objects, while the auxiliary brushes can be used to clean smaller surfaces or objects. The cap can be disengaged from the cap end of the body to simultaneously expose the auxiliary brushes. The cap can be used as a grip for use of one auxiliary brush, while the body can be used as a grip for use of the other auxiliary brush. The fixated position of one auxiliary brush to the body and the fixated position of the other auxiliary brush to the cap advantageously reduces the likelihood of the auxiliary brushes being misplaced.

Figure 9:
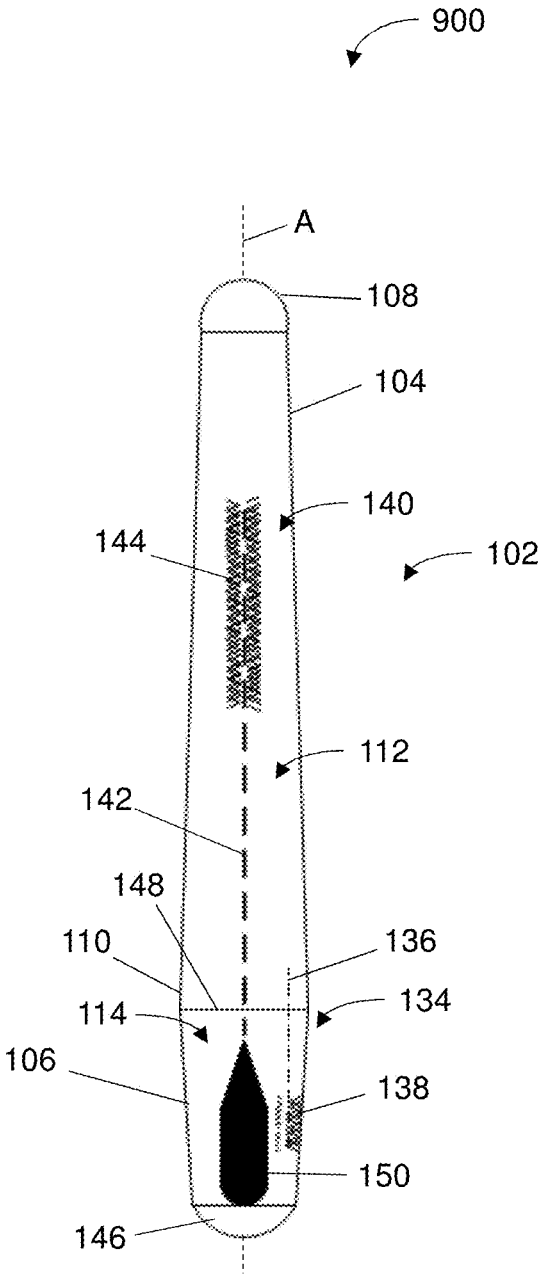
FIG. 9 is a diagrammatic front view of an exemplary brush assembly in an embodiment providing a first and second auxiliary brush without a main brush.

In another embodiment, the brush assembly may include first and second auxiliary brushes as described herein located with the inner chamber of a handle that does not also include a main brush. For example, FIG. 9 depicts a diagrammatic front view of another embodiment of an exemplary brush assembly 900 that does not include a main brush 126. As depicted in FIG. 9, the brush assembly 900 can be substantially similar in structure and function to the brush assembly 100, except for the distinctions noted herein. Therefore, like reference numbers are used to represent like structures. In particular, FIG. 9 depicts a first auxiliary brush 140 and a second auxiliary brush 134, positioned within a chamber 112 of a brush assembly handle 102. It will be appreciated that the orientations of the first auxiliary brush 140 and the second auxiliary brush 134 can be reversed without departing from the scope of the present invention.

Figure 10:
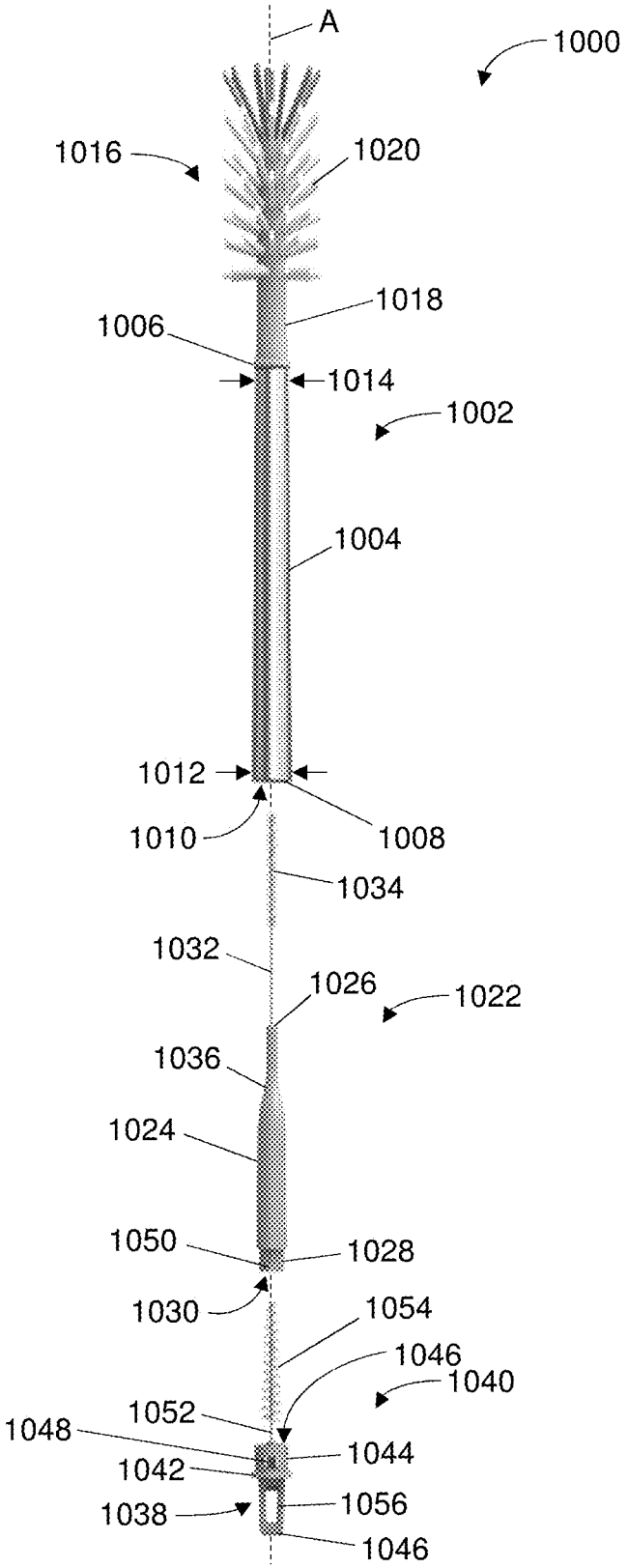
FIG. 10 is a diagrammatic front view of an exemplary brush assembly in an embodiment including a main brush, a first brush and a second brush in a nested configuration.

FIG. 10 is a diagrammatic front view of an exemplary brush assembly 1000 in accordance with exemplary embodiments. The brush assembly 1000 can be substantially similar in structure and function to the brush assembly 100, except for the distinctions noted herein. The brush assembly 1000 generally includes a handle 1002 including a body 1004. The handle 1002 defines an elongated and substantially cylindrical, tubular shape. The body 1004 includes a brush end 1006 and an opposing cap end 1008. In certain embodiments, the brush end 1006 can connect to the body 1004 at a circumferential lip. The handle 1002 is at least partially hollow and defines an inner chamber 1010 within the body 1004.

In an embodiment, the body 1004 can taper from a first diameter 1012 at or near the cap end 1008 to a second diameter 1014 at or near the brush end 1006. For example, the first diameter 1012 can be dimensioned greater than the second diameter 1014. The tapered configuration of the body 1004 provides an improved grip to the user and allows for a greater inner chamber 1010 at or near the cap end 1008 for nesting of the auxiliary brushes.

A brush 1016 (e.g., a main brush) is attached to and extends from the brush end 1014 of the body 1004. The main brush 1016 can be in the form of a bristle top brush including an elongated support 1018 connected to the brush end 1014 and bristles 1020 extending from the elongated support 1018. The body 1004 and the elongated support 1018 can be fabricated from different materials. In an embodiment, the bristles 1020 can be fabricated from, e.g., stainless steel, copper, thermoplastic elastomer (TPE), polypropylene, polyethylene, polystyrene, polyvinyl chloride, polycarbonate, acrylonitrile butadiene styrene (ABS), silicone, nylon, blends of one or more materials, or the like. In an embodiment, the brush assembly 1000 can include a cap (not shown) configured to be positioned over the main brush 1016 during storage of the brush assembly 1000.

The brush assembly 1000 may include a brush 1022 (e.g., a first auxiliary brush). The brush 1022 includes a body 1024 with a brush end 1026 and a cap end 1028. The body 1024 can be in the form of a cylindrical or tubular configuration having an inner chamber 1030. The brush end 1026 is coupled to an elongated support 1032 with bristles 1034 secured and extending from the elongated support 1032. In an embodiment, the body 1024 of the brush 1022 can gradually taper or curve at a narrowed region 1036 from a larger central diameter to a smaller diameter at or near the brush end 1026.

The narrowed region 1036 ensures clear entry of the brush 1022 into the inner chamber 1010 of the brush 1002. Particularly, during storage, the brush 1022 can be completely nested or housed within the inner chamber 1010 of the brush 1002. In an embodiment, the cap end 1028 can define a diameter dimensioned smaller than the central diameter and larger than the smaller diameter at the brush end 1026. In an embodiment, the cap end 1028 can include outer threads to engage with complementary inner threads of a cap 1038 associated with a brush 1040 (e.g., a second auxiliary brush). In an embodiment, the cap end 1028 can include one or more protrusions on an outer surface that create a snap or friction fit with the inner surface of the cap 1038.

The cap 1038 includes a central circumferential lip 1042 that separates the cap 1038 into an upper half 1044 and a lower half 1046. The upper half 1044 defines a substantially cylindrical, hollow structure configured to receive therein and engage with the cap end 1028 of the brush 1022. Particularly, the upper half 1044 includes an inner chamber 1046 that at least partially receives therein the cap end 1028 of the brush 1022. In an embodiment, the inner surface of the inner chamber 1046 includes threads configured to engage with outer threads of the cap end 1028. In an embodiment, the upper half 1044 includes an aperture 1048 passing into the inner chamber 1046 that releasably engages with a radial protrusion 1050 extending from the cap end 1028. The cap 1038 can thereby be detachably engaged or interlocked with the brush 1022.

The brush 1040 includes an elongated support 1052 coupled to the cap 1038 and extending from the inner chamber 1046. The brush 1040 includes bristles 1054 extending from the elongated support 1052. During engagement of the cap 1038 with the brush 1022, the brush 1040 is completely nested or housed within the inner chamber 1030 of the brush 1022. The outer surface of the upper half 1044 can include outer threads that engage with inner threads of the brush end 1008 of the brush 1002, thereby allowing for interlocking between the cap 1038 and the handle 1004.

Particularly, the upper half 1044 fits within the cap end 1008 of the handle 1004 during engagement, nesting both brushes 1022, 1040 within the inner chamber 1010 of the brush 1002. In an embodiment, rather than threads, the cap 1038 can engage with the handle 1004 via an interference, friction or snap fit. In an embodiment, the bottom half 1046 of the cap 1038 can include an opening 1056 passing through the cap 1038 for hanging the brush assembly 1000 on, e.g., a hook.

While exemplary embodiments have been described herein, it is expressly noted that these embodiments should not be construed as limiting, but rather that additions and modifications to what is expressly described herein also are included within the scope of the invention. Moreover, it is to be understood that the features of the various embodiments described herein are not mutually exclusive and can exist in various combinations and permutations, even if such combinations or permutations are not made express herein, without departing from the spirit and scope of the invention.

The invention claimed is:

1. A brush assembly, comprising:

a handle including:

a body with a brush end and a cap end, the body being at least partially hollow to define an inner chamber, and a cap removable from the cap end of the body, the cap configured to be positioned in an attached position when attached to the cap end of the body and a removed position when removed from the cap end of the body, the cap including an inner chamber;

a main brush attached to and extending from the brush end of the body;

a first auxiliary brush detachably engaged with the cap and including a body with an inner chamber, the first auxiliary brush having a cap end detachably engaged with an inner surface of the inner chamber of the cap and the first auxiliary brush being enclosed within the inner chamber of the handle when the cap is in the attached position; and a second auxiliary brush extending from the cap, the second auxiliary brush being enclosed within the inner chamber of the first auxiliary brush when the cap is in the attached position.

2. The brush assembly of claim 1, wherein the handle includes a central longitudinal axis, and the first and second auxiliary brushes extend in the same direction when the cap is in the attached position.

3. The brush assembly of claim 2, wherein the main brush, the first auxiliary brush, and the second auxiliary brush are aligned along the central longitudinal axis when the cap is in the attached position.

4. The brush assembly of claim 1, wherein the handle includes a first diameter at or near the cap end and a second diameter at or near the brush end.

5. The brush assembly of claim 4, wherein the first diameter is dimensioned greater than the second diameter to define a tapered body.

6. The brush assembly of claim 1, wherein the cap includes an upper half, the upper half of the cap including the inner chamber of the cap.

7. The brush assembly of claim 1, wherein the cap end of the first auxiliary brush includes a radial protrusion and the upper half of the cap includes an aperture, the radial protrusion configured to detachably engage with the aperture of the cap.

8. The brush assembly of claim 1, wherein the upper half of the cap is configured to be nested within the cap end of the handle.

9. The brush assembly of claim 1, wherein the cap includes a lower half with an opening passing therethrough.

10. A brush assembly, comprising:

a handle including:

a body with a brush end and a cap end, the body being at least partially hollow to define an inner chamber, and a cap removable from the cap end of the body, the cap configured to be positioned in an attached position when attached to the cap end of the body and a removed position when removed from the cap end of the body, the cap including an inner chamber;

a first brush detachably engaged with the cap and including a body with an inner chamber, the first brush having a cap end detachably engaged with an inner surface of the inner chamber of the cap and the first brush being enclosed within the inner chamber of the handle when the cap is in the attached position; and a second brush extending from the cap, the second brush being enclosed within the inner chamber of the first brush when the cap is in the attached position.

11. The brush assembly of claim 10, the handle includes a central longitudinal axis, and the first and second brushes extend in the same direction when the cap is in the attached position.

12. The brush assembly of claim 10, wherein the first and second brushes are aligned along a central longitudinal axis when the cap is in the attached position.

13. The brush assembly of claim 10, wherein the handle includes a first diameter at or near the cap end and a second diameter at or near the brush end.

14. The brush assembly of claim 13, wherein the first diameter is dimensioned greater than the second diameter to define a tapered body.

15. The brush assembly of claim 10, wherein the cap includes an upper half, the upper half of the cap including the inner chamber of the cap.

16. The brush assembly of claim 10, wherein the cap end of the first brush includes a radial protrusion and the upper half of the cap includes an aperture, the radial protrusion configured to detachably engage with the aperture of the cap.

17. The brush assembly of claim 10, wherein the upper half of the cap is configured to be nested within the cap end of the handle.

18. A brush assembly, comprising:

a handle including:

a body with a brush end and a cap end, the body being at least partially hollow to define an inner chamber, and a cap removable from the cap end of the body, the cap configured to be positioned in an attached position when attached to the cap end of the body and a removed position when removed from the cap end of the body;

a main brush attached to and extending from the brush end of the body;

a first auxiliary brush extending from the cap, the first auxiliary brush being enclosed within the cap and the inner chamber of the handle when the cap is in the attached position, the handle, the main brush and the first auxiliary brush each extending along and aligned with a central longitudinal axis of the brush assembly; and a second auxiliary brush extending from and beyond the cap end of the handle when the cap is in the removed position, the second auxiliary brush being enclosed within the cap and inner chamber of the handle when the cap is in the attached position, and the second auxiliary brush offset from the central longitudinal axis of the brush assembly and extending parallel to the central longitudinal axis of the brush assembly.

19. The brush assembly of claim 18, wherein the main brush and the first auxiliary brush are oriented in the same direction, and the second auxiliary brush is oriented in an opposing direction from the main brush and the first auxiliary brush.

20. The brush assembly of claim 18, wherein the second auxiliary brush is fixedly secured to the cap end of the handle.

* * * * *